US007856783B2

(12) United States Patent
Ries

(10) Patent No.: US 7,856,783 B2
(45) Date of Patent: Dec. 28, 2010

(54) METHOD FOR RECONSTRUCTING STONES HAVING AT LEAST ONE SPALLING, AND STONE RECONSTRUCTED ACCORDING TO SAID METHOD

(76) Inventor: Ernst Ries, Juliusstrasse 12, D-36154, Hosenfeld (DE)

( * ) Notice: Subject to any disclaimer, the term of this patent is extended or adjusted under 35 U.S.C. 154(b) by 1031 days.

(21) Appl. No.: 10/469,925

(22) PCT Filed: Mar. 6, 2002

(86) PCT No.: PCT/DE02/00796

§ 371 (c)(1),
(2), (4) Date: Mar. 29, 2004

(87) PCT Pub. No.: WO02/070823

PCT Pub. Date: Sep. 12, 2002

(65) Prior Publication Data

US 2004/0148906 A1 Aug. 5, 2004

(30) Foreign Application Priority Data

Mar. 6, 2001 (DE) ..... 101 10 629

(51) Int. Cl.
*E02D 37/00* (2006.01)

(52) U.S. Cl. ..... 52/514; 52/310; 52/741.41

(58) Field of Classification Search ..... 52/310, 52/514, 514.5, 601, 604, 741.41
See application file for complete search history.

(56) References Cited

U.S. PATENT DOCUMENTS 3,706,615 A * 12/1972 Nishiyama et al. ..... 156/169
4,392,335 A * 7/1983 Heiman ..... 52/309.17
4,759,988 A * 7/1988 Yamamoto et al. ..... 428/402
5,794,401 A * 8/1998 Shaw et al. ..... 52/741.41
5,866,754 A * 2/1999 De Blangy et al. ..... 588/318
6,293,065 B1 * 9/2001 Suzuki et al. ..... 52/315

FOREIGN PATENT DOCUMENTS

| | | |
|---|---|---|
| DE | 8526108 | 1/1986 |
| DE | 4307676 | 9/1994 |
| EP | 0471978 | 2/1992 |

OTHER PUBLICATIONS

English translation of Reinsdorf.*
"concrete." The American Heritage® Dictionary of the English Language, Fourth Edition. Houghton Mifflin Company, 2004. Feb. 23, 2009. <http://www.bartleby.com/61/2/C0550200.html>.*
S. Reinsdorf, "Leichtbeton: Leichtbetone aus porigen Zuschlagstoffen" VES 1961, vol. 1, pp. 227, 228, 377, 378.
"Optimization of the mixture of no-fines lightweight concrete" BFT 1999, Issue 11, pp. 70-76.
German Office Action dated Jan. 8, 2004 and its English-language translation.

* cited by examiner

*Primary Examiner*—Richard E Chilcot, Jr.
*Assistant Examiner*—Branon C Painter
(74) *Attorney, Agent, or Firm*—Crowell & Moring LLP

(57) ABSTRACT

A method for reconstructing residual stones having at least one spalling wherein an adhesive layer is first applied grid-like on the residual stone in the area of the spalling, but leaving at least many areas free of the adhesive layer; then a leveling layer of mortar is applied; and subsequently a thin anti-abrasion layer is applied on the leveling layer; and where the leveling layer of mortar has drainage channels to convey the moisture out of the residual stone to at least one end of the stone. The invention also relates to a stone, reconstructed according to the method.

4 Claims, 1 Drawing Sheet

METHOD FOR RECONSTRUCTING STONES HAVING AT LEAST ONE SPALLING, AND STONE RECONSTRUCTED ACCORDING TO SAID METHOD

BACKGROUND OF THE INVENTION

This invention relates to a method for reconstructing residual stones having at least one spalling. More particularly, this invention relates to a method for reconstructing residual stones having at least one spalling wherein an adhesive layer is first applied grid-like on the residual stone in the area of the spalling, but leaving at least many areas free of the adhesive layer; then a leveling layer of mortar is applied; and subsequently a thin anti-abrasion layer is applied on the leveling layer; and where the leveling layer of mortar has drainage channels to convey the moisture out of the residual stone to at least one end of the stone. Furthermore, the invention relates to a stone, reconstructed according to the method.

A method of the type described above and a stone, reconstructed according to this method, are the subject matter of DE 43 07 676 C2. In the case of the prior art method and stone the drainage channels are formed by single lines, made, for example, of gravel stones, in the leveling layer of mortar. These drainage channels, formed by such lines, lead to the respective ends of the stone. Thus, water vapor from the residual stone below the grid-like adhesive layer can escape to the environment by way of the drainage channels so that the stone does not have to be dried before the repair work is done. Furthermore, the risk of subsequently spalling due to vapor pressure building up in the residual stone is eliminated. The prior art method has proved successful in reconstructing curbstones, but the need to form drainage channels by means of lines made of coarser stones has resulted in relatively high costs, which especially for relatively new and dry stones to be reconstructed often seem inappropriate.

SUMMARY OF THE INVENTION

The invention is based on the problem of designing a method of the type described above in such a manner that drainage at as low a cost as possible is possible. Furthermore, a stone, reconstructed according to the method of the invention, shall be provided that shall be produced at as low a cost as possible.

The former problem is solved by the invention in that the drainage channels are formed exclusively by the use of a leveling layer of mortar, made of an open pored fabricated mortar.

Owing to the inventive application of a leveling layer of mortar that is open to vapor pressure there is no need to form individual lines made of coarse stones for the purpose of generating drainage channels. Moisture of the residual stone can go through the leveling layer of mortar to the two face sides of the stone and there be released to the environment without the need for any special measures to accomplish this—aside from the use of an open pore leveling layer of mortar. Therefore, the method of the invention is especially economical compared to the prior art method. Furthermore, with the method according to the invention it is ruled out that the drainage channels will slide out of position when the leveling layer of mortar is being formed or when at a later date the drainage channels are damaged and thus do not run completely to the face sides of the stone.

High vapor permeability at still adequate compression strength ranging from 30 to 40 N/mm$^2$ can be achieved if, according to another advantageous improvement of the method, the mortar for the leveling layer of mortar is made of solids having an exclusive grain size ranging from 0.6 to 1.5 mm in diameter and a synthetic resin, connecting the solids together. In such a mortar the synthetic resin compensates somewhat for the drop in compression strength resulting from the use of the relatively coarse solids.

The production of the mortar, required for the method of the invention, is especially economical if the mortar for the leveling layer of mortar is produced from a commercially available synthetic resin mortar to which is added the same quantity or up to twice the quantity of solids having an exclusive grain size ranging from 0.6 to 1.5 mm. Due to this procedure there is no need to add any synthetic resin to the mortar, because the quantity of resin in the commercially available synthetic resin mortar is surprisingly adequate enough even despite the added, relatively large proportion of solids, because the synthetic resin can envelop the individual solids with a relatively thin resin layer and because the very stable anti-abrasion layer, which covers the leveling layer of mortar, distributes any occurring pressure force uniformly over the leveling mortar.

The mortar can be produced especially economically if recycled materials are added to the leveling layer of mortar.

The reconstructed stone's capacity to release vapor is increased when even the anti-abrasion layer is also made of a vapor permeable material.

It is also advantageous if a leveling mortar is used that has a different coloration than the material for the anti-abrasion layer. Such a different coloration makes it easy to assure that the anti-abrasion layer is applied adequately thick if one applies the anti-abrasion layer so thick that the leveling mortar can no longer be seen through said anti-abrasion layer.

The second aforementioned problem, i.e. producing a stone reconstructed according to the method of the invention, is solved by the invention in that the drainage channels are formed by the entire leveling layer of mortar by making the layer of an open pored fabricated mortar. Such a stone is more economical to produce than stones with defined drainage channels, but still has adequate vapor permeability for some applications.

The reconstructed stone can be produced especially economically if the leveling layer of mortar is made of solids having a grain size ranging from 0.6 to 1.5 mm in diameter and a synthetic resin, connecting the solids together.

The stone, according to the invention, can serve simultaneously to recycle waste material, if the leveling layer of mortar contains recycled materials.

As an alternative to a synthetic resin mortar, it can also be provided for cost reasons that the layer of synthetic mortar be a cement-bonded single sized mortar.

The vapor permeability can be further increased by also making the anti-abrasion layer of a vapor-permeable material.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
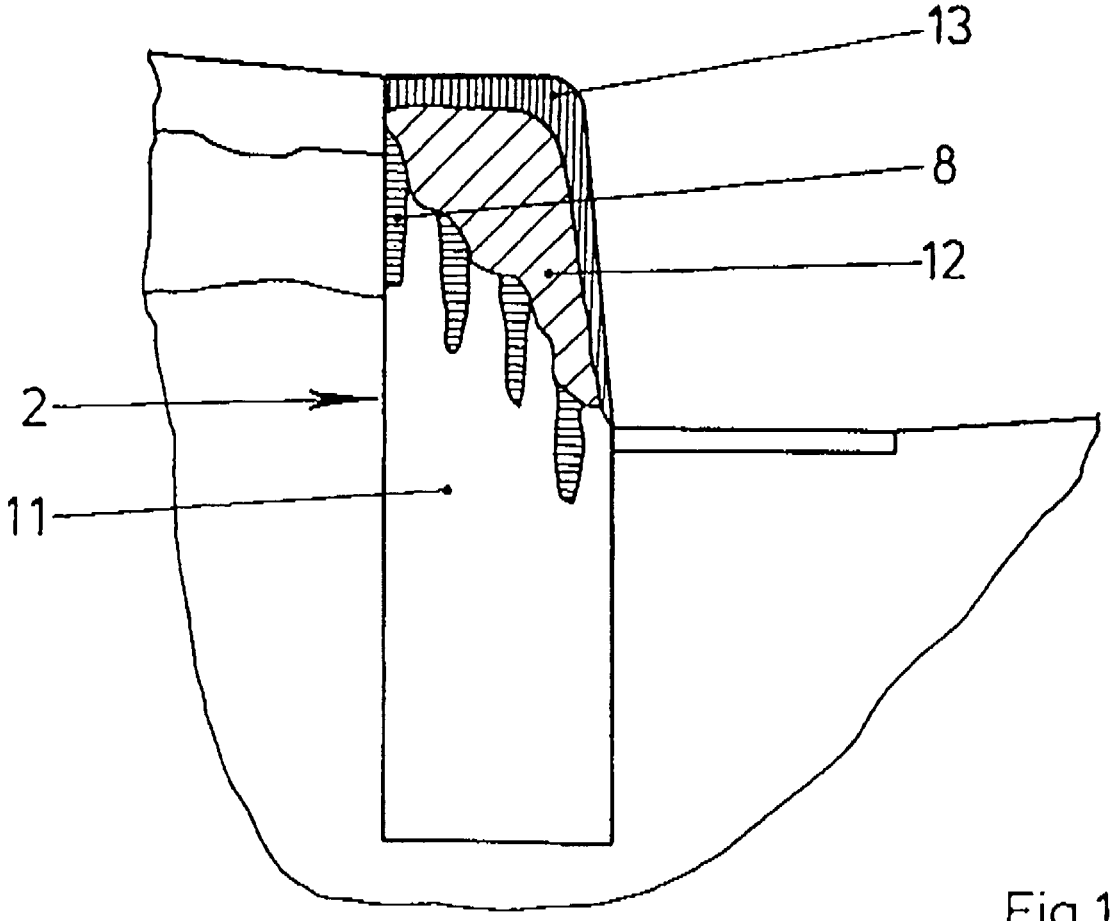
FIG. 1 is an elevational, partly in cross-section, view of a stone completely reconstructed according to the invention.

The sectional view, according to FIG. 1, shows a completely reconstructed stone 2. It is clear that an adhesive layer 8 was applied grid-like on a residual stone 11 standing in the concrete area, but leaving many areas free of said adhesive layer. The adhesive layer has penetrated in some places into the residual stone 11 and has produced there formations, comparable to anchors. A leveling layer 12 of mortar, which is made of an open pored fabricated mortar, is applied on the adhesive layer 8. To this end, the mortar is made of solids having an exclusive grain size ranging from 0.6 to 1.5 mm in diameter and a synthetic resin, connecting the solids together. The solids can also be sand. The leveling mortar can be made flexible.

Towards the top and the front the leveling layer 12 of mortar is covered by an anti-abrasion layer 13, which can also be permeable to vapor, but which may not envelop the face sides of the leveling layer 12 of mortar so that the moisture from the leveling layer 12 of mortar can also be released on the face sides.

Figure 2:
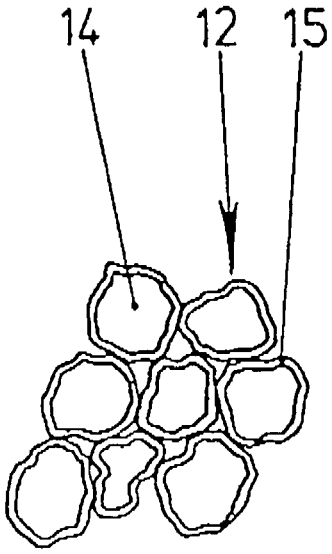
FIG. 2 is an enlarged sectional view of the stone of FIG. 1, showing a detail of a leveling layer of mortar of the stone.

FIG. 2 shows individual solids 14 of the leveling layer 12 of mortar; the solids are enveloped by a sheath 15 of synthetic resin.

The invention claimed is:

1. A method for reconstructing a residual stone having at least one spalling comprising first applying an adhesive layer grid-like on the residual stone in the area of the spalling, but leaving a plurality of areas free of said adhesive layer; then applying a leveling layer of mortar; and subsequently applying a thin anti-abrasion layer on said leveling layer; wherein the leveling layer of mortar has drainage channels that convey moisture out of the residual stone to at least one end of the stone, said drainage channels are formed exclusively by said leveling layer of mortar which is made of an open pored fabricated mortar; wherein the anti-abrasion layer is made of a vapor-permeable material; and wherein the mortar for the leveling layer of mortar is made of solids having an exclusive grain size ranging from 0.6 to 1.5 mm in diameter and a synthetic resin connecting the solids together.

2. A method as claimed in claim 1, wherein the mortar for the leveling layer of mortar is produced from a commercially available synthetic resin mortar to which is added the same quantity or up to twice the quantity of solids having an exclusive grain size ranging from 0.6 to 1.5 mm.

3. A method for reconstructing a residual stone having at least one spalling comprising:

applying an adhesive layer grid-like on the residual stone in the area of the spalling, but leaving a plurality of areas free of said adhesive layer;

enveloping individual solids of mortar with synthetic resin to produce mortar with solids enveloped by sheaths of the synthetic resin and applying a leveling layer of the mortar; and applying a thin anti-abrasion layer on said leveling layer;

wherein the leveling layer of mortar has drainage channels that convey moisture out of the residual stone to at least one end of the stone, and said drainage channels are formed exclusively by said leveling layer of mortar, which is made of an open pored fabricated mortar;

wherein the anti-abrasion layer is made of a vapor-permeable material;

wherein vapor can penetrate through the leveling layer to end faces and, also, to an outer visible face of the stone; and wherein the solids have an exclusive grain size ranging from 0.6 to 1.5 mm in diameter and the synthetic resin connects the solids together.

4. A method for reconstructing a residual stone having at least one spalling comprising:

applying an adhesive layer grid-like on the residual stone in the area of the spalling, but leaving a plurality of areas free of said adhesive layer;

enveloping individual solids of mortar with synthetic resin to produce mortar with solids enveloped by sheaths of the synthetic resin and applying a leveling layer of the mortar; and applying a thin anti-abrasion layer on said leveling layer;

wherein the leveling layer of mortar has drainage channels that convey moisture out of the residual stone to at least one end of the stone, and said drainage channels are formed exclusively by said leveling layer of mortar, which is made of an open pored fabricated mortar;

wherein the anti-abrasion layer is made of a vapor-permeable material;

wherein vapor can penetrate through the leveling layer to end faces and, also, to an outer visible face of the stone; and wherein the mortar for the leveling layer of mortar is produced from a commercially available synthetic resin mortar to which is added the same quantity or up to twice the quantity of the solids, and wherein the solids have an exclusive grain size ranging from 0.6 to 1.5 mm.

* * * * *